US008597440B2

(12) United States Patent
Lupulescu et al.

(10) Patent No.: US 8,597,440 B2
(45) Date of Patent: Dec. 3, 2013

(54) PROCESS AND ALLOY FOR TURBINE BLADES AND BLADES FORMED THEREFROM

(75) Inventors: Afina Lupulescu, Troy, NY (US); Robert Edward Deallenbach, Schenectady, NY (US); Robin Carl Schwant, Pattersonville, NY (US)

(73) Assignee: General Electric Company, Schenectady, NY (US)

( * ) Notice: Subject to any disclaimer, the term of this patent is extended or adjusted under 35 U.S.C. 154(b) by 1373 days.

(21) Appl. No.: 12/550,919

(22) Filed: Aug. 31, 2009

(65) Prior Publication Data

US 2011/0052409 A1 Mar. 3, 2011

(51) Int. Cl.
*F01D 5/28* (2006.01)
*C22F 1/10* (2006.01)

(52) U.S. Cl.
USPC ..... 148/555; 416/241 R; 148/675

(58) Field of Classification Search
USPC ..... 148/675, 555; 416/241 R
See application file for complete search history.

(56) References Cited

U.S. PATENT DOCUMENTS

| | | | | |
|---|---|---|---|---|
| 3,457,066 | A | 7/1969 | Pohlman et al. | |
| 3,536,542 | A | 10/1970 | Murphy et al. | |
| 4,478,638 | A | 10/1984 | Smith, Jr. et al. | |
| 5,374,319 | A | 12/1994 | Stueber et al. | |
| 5,897,718 | A * | 4/1999 | Hessell et al. | 148/410 |
| 6,132,527 | A | 10/2000 | Hessell et al. | |

OTHER PUBLICATIONS

Sim Chester Thomas et al: "Superalloys II, Passage", Jan. 1, 1987, Superalloys II, New York, Wiley, US, XP008130299, ISBN: 978-0-471-01147-7 pp. 579-586, p. 580-pp. 584, 585; tables B1,B3.

Anonymous: "Alloy: Rene 77", Metaltek Interantional, Jan. 1, 2009, XP002613780.

Anonymous: "SAE AS 5491C Calculation of Electron Vacancy Number in Superalloys", IHS—The source for Critical Information and Insight, Nov. 1, 2007, XP002613781.

Antolovich S D et al: "Low cycle fatigue of Rene 77 at elevated temperatures", Materials Science Engineering, vol. 47, No. 1, Jan. 1, 1981, pp. 47-57, XP024085786, ISSN: 0025-5416 DOI.

* cited by examiner

*Primary Examiner* — Jesse R. Roe
(74) *Attorney, Agent, or Firm* — Ernest G. Cusick; Gary M. Hartman; Domenica N. S. Hartman

(57) ABSTRACT

A process and alloy for producing a turbine blade whose properties enable the blade to operate within a steam turbine at maximum operating temperatures of greater than 1300° F. (about 705° C.). The process includes casting the blade from a gamma prime-strengthened nickel-base superalloy having a composition of, by weight, 14.25-15.75% cobalt, 14.0-15.25% chromium, 4.0-4.6% aluminum, 3.0-3.7% titanium, 3.9-4.5% molybdenum, 0.05-0.09% carbon, 0.012-0.020% boron, maximum 0.5% iron, maximum 0.2% silicon, maximum 0.15% manganese, maximum 0.04% zirconium, maximum 0.015% sulfur, maximum 0.1% copper, balance nickel and incidental impurities, and an electron vacancy number of 2.32 maximum. The casting then undergoes a high temperature solution heat treatment to promote resistance to hold-time cracking. The blade exhibits a combination of yield strength, stress rupture properties, environmental resistance, and cost in steam turbine applications to 1400° F. (about 760° C.).

15 Claims, 5 Drawing Sheets

PROCESS AND ALLOY FOR TURBINE BLADES AND BLADES FORMED THEREFROM

BACKGROUND OF THE INVENTION

The present invention generally relates to materials and processes for producing castings for high temperature applications, and particularly buckets for steam turbines intended to have operating temperatures that exceed 1300° F. (about 705° C.).

Components of steam turbines, such as nozzles (stationary blades) and buckets (rotating blades) of steam turbines, are typically formed of stainless steel, nickel, and cobalt-base alloys that exhibit desirable mechanical properties at typical steam turbine operating temperatures of about 1000° F. to about 1050° F. (about 538° C. to about 566° C.). Because the efficiency of a steam turbine plant is dependent on its operating temperature, there is a demand for components and particularly turbine buckets and nozzles that are capable of withstanding higher operating temperatures of 1300° F. (about 705° C.) and above. In particular, the development of next generation steam turbines capable of maximum operating temperatures of up to about 1400° F. (about 760° C.) are currently under consideration.

As the operating temperatures for steam turbine components increase, different alloy compositions and processing methods must be used to achieve a balance of mechanical, physical and environmental properties required for the applications. Steam turbine buckets capable of withstanding temperatures in excess of 1300° F. (about 705° C.) will require bucket alloys having substantially improved creep-rupture and stress relaxation capabilities compared to current steam turbine bucket alloys such as martensitic stainless steel Crucible 422, and compared to intermediate strength nickel-base alloys such as Waspaloy. In addition, suitable bucket alloys must also meet or exceed component yield strength requirements and resist environmental cracking and other types of degradation in steam, while also minimizing overall component cost.

BRIEF DESCRIPTION OF THE INVENTION

The present invention provides a process and alloy for producing a turbine blade whose properties enable the blade to operate within a turbine, and particularly a bucket for use in a steam turbine having an operating temperature of greater than 1300° F. (about 705° C.).

According to a first aspect of the invention, the process includes casting the blade from a gamma prime-strengthened nickel-base superalloy having a composition of, by weight, 14.25-15.75% cobalt, 14.0-15.25% chromium, 4.0-4.6% aluminum, 3.0-3.7% titanium, 3.9-4.5% molybdenum, 0.05-0.09% carbon, 0.012-0.020% boron, maximum 0.5% iron, maximum 0.2% silicon, maximum 0.15% manganese, maximum 0.04% zirconium, maximum 0.015% sulfur, maximum 0.1% copper, balance nickel and incidental impurities, and an electron vacancy number of 2.32 maximum. After casting, the blade is solution heat treated at a solution temperature of about 1100 to about 1200° C. (about 2010 to about 2190° F.) in an inert atmosphere for a duration of about one to about five hours, cooled to a first cooling temperature of about 1000 to about 1100° C. (about 1830 to about 2010° F.), cooled to a second cooling temperature of about 500 to about 600° C. (about 930 to about 1110° F.), and then cooled to about 20° C. (room temperature). The blade is then aged at an aging temperature of about 700 to about 800° C. (about 1290 to about 1470° F.) for about ten to about twenty hours, and then cooled to about 20° C. (room temperature). The resulting blade material has a 0.2% yield strength of at least 690 MPa (about 100 ksi) over an operating temperature range from about 20° C. (about 70° F.) through about 760° C. (about 1400° F.), a gamma prime phase content (volume fraction) of about 45% to about 55% at a temperature of about 760° C. (about 1400° F.), and a sigma phase content (volume fraction) of less than 5% at a temperature of about 700° C. (about 1290° F.).

Other aspects of the invention include a turbine blade, for example a steam turbine bucket, formed in a manner as described above, and a steam turbine equipped with the blade.

A significant advantage of this invention is that a turbine blade produced from the alloy and its processing as described above is believed capable of achieving the required material characteristics consistent with steam turbine operating temperatures of greater than 1300° F. (about 705° C.), and as high as about 1400° F. (about 760° C.). As a result, turbine blades of this invention are capable of use in next generation steam turbines whose efficiencies exceed those of existing steam turbines.

Other aspects and advantages of this invention will be better appreciated from the following detailed description.

DETAILED DESCRIPTION OF THE INVENTION

Figure 1:
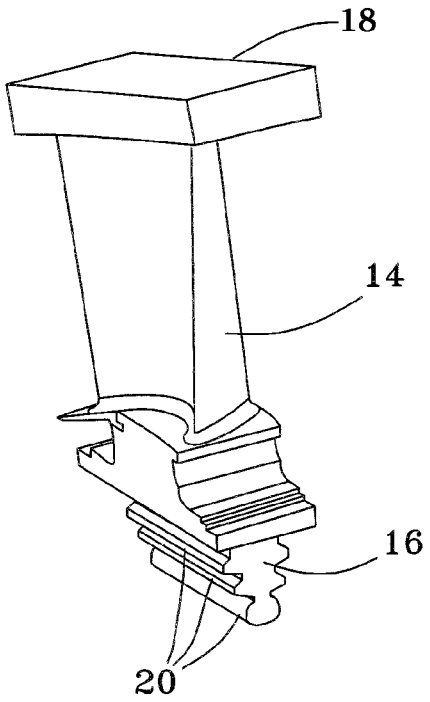
FIG. 1 is representative of a steam turbine bucket that can be formed from a nickel-base alloy using an alloy and process according to an embodiment of the present invention.
Figure 2:
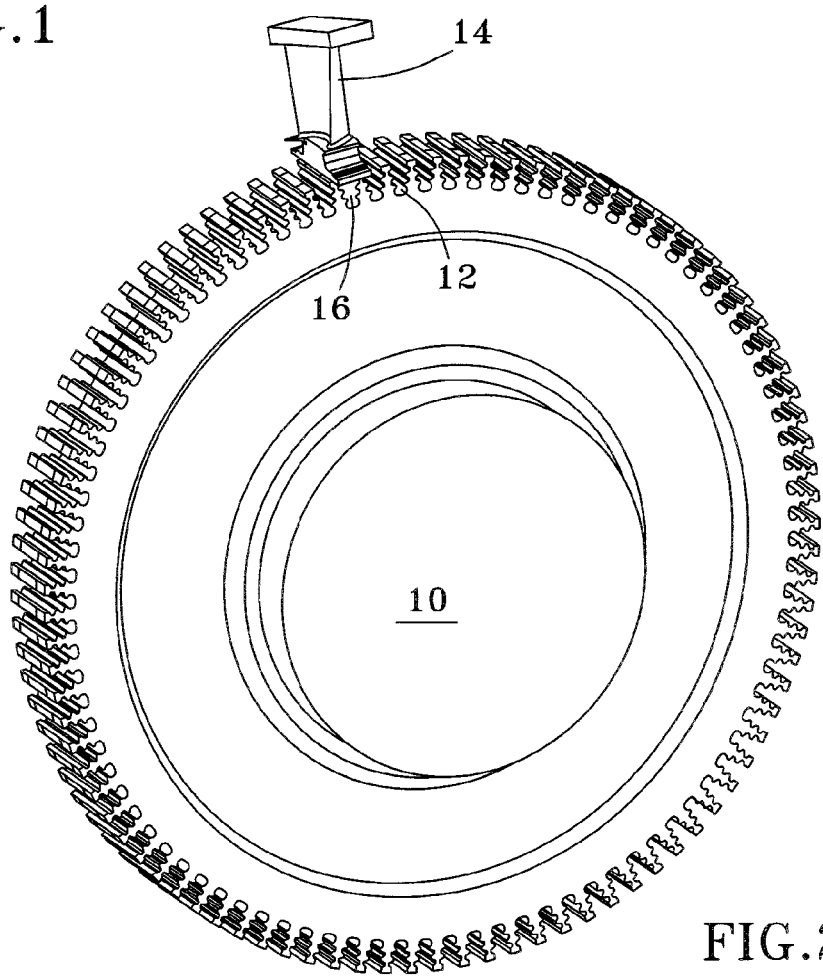
FIG. 2 represents a steam turbine bucket of the type shown in FIG. 1 installed on a steam turbine wheel.

FIG. 1 represents a perspective view of a steam turbine bucket 14 and FIG. 2 represents the bucket 14 installed on a steam turbine wheel 10 having axial-entry female dovetail slots 12. As well understood in the art, the bucket 14 is configured to be secured to the wheel 10 by inserting a male dovetail 16 of the bucket 14 into one of the dovetail slots 12. The dovetail slot 12 and dovetail 16 are complementary in shape and size to provide a close fit therebetween, such that alternating lobes or hooks 20 of each dovetail slot 12 and its corresponding dovetail 16 bear against each other when the wheel 10 is rotated at high speeds. FIGS. 1 and 2 further shows the buckets 14 as terminating with integral covers 18. The coupling of covers 20 of adjacent buckets 14 is known to be necessary for minimizing tip leakage and controlling bucket vibration. The wheel 10, bucket 14, and their respective dovetail slots 12 and dovetails 16 are of known configurations in the art, and do not pose any particular limitations to the scope of the invention aside from the intended application for the buckets 14 in a steam turbine.

The present invention provides for the capability of producing steam turbine bucket castings with improved high temperature properties. At typical steam turbine operating temperatures of about 1000 to about 1050° F. (about 538 to about 566° C.), buckets of the type represented in FIGS. 1 and 2 are conventionally produced from iron-base alloys, including series 400 martensitic stainless steels such as Crucible 422. However, to improve the steam turbine performance, there is an ongoing need to substantially increase turbine inlet temperatures, requiring that steam turbine buckets, such as the buckets 14 in FIGS. 1 and 2, withstand significantly higher operating temperatures.

Figure 3:
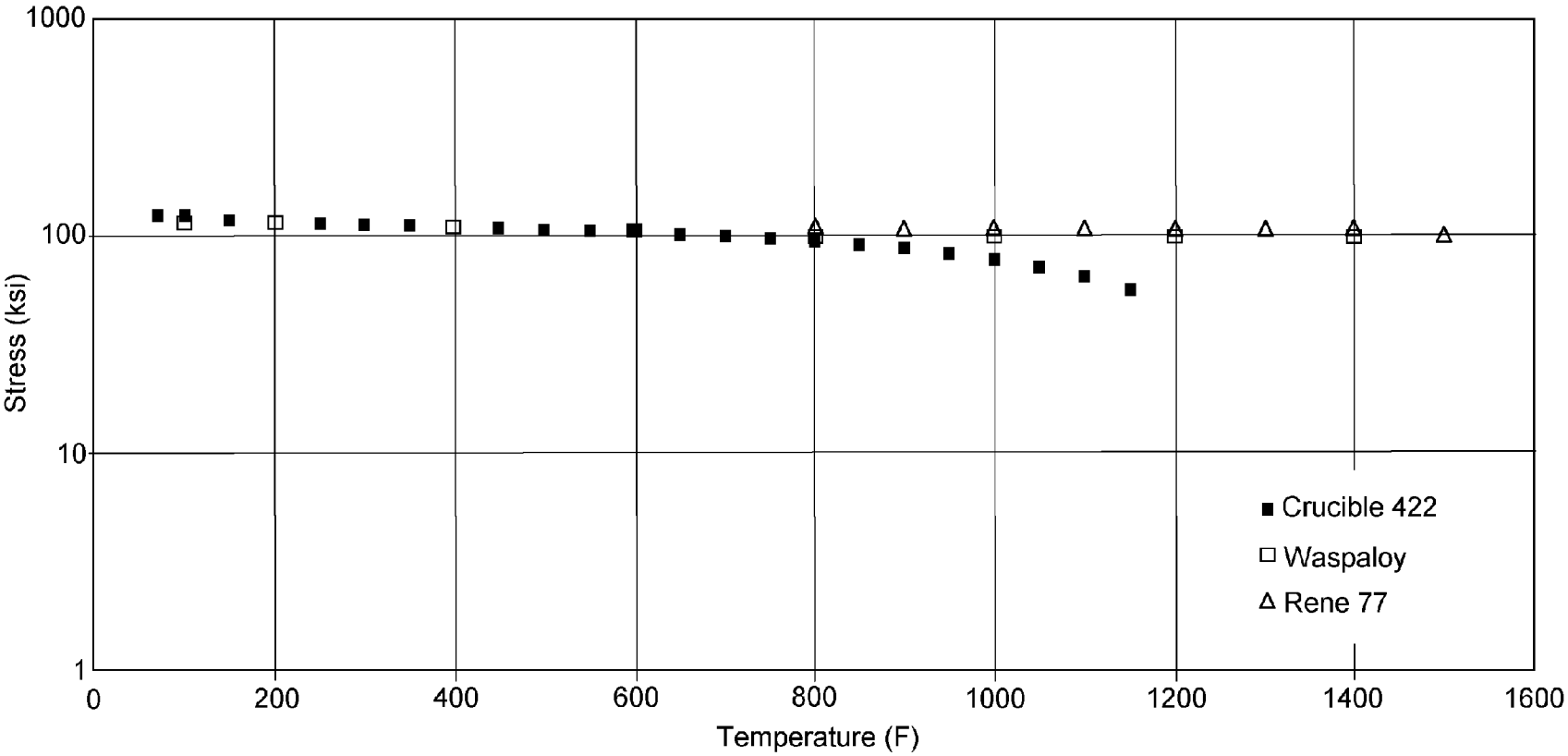
FIG. 3 is a graph plotting 0.2% yield strength of an alloy currently used to produce steam turbine buckets, an intermediate strength nickel-base alloy, and a nickel-base alloy within the scope of the present invention.

FIG. 3 plots the 0.2% average yield strength of Crucible 422, Waspaloy, and a nickel-base superalloy commercially known as René 77. The yield strength data are plotted over a temperature range from about room temperature (about 20° C. or about 70° F.) to about 1400° F. (about 760° C.). From FIG. 3 it can be seen that Crucible 422 does not exhibit adequate yield strength above about 1100° F. (about 595° C.), whereas Waspaloy and René 77 provide a greater yield strength over an operating temperature range from room temperature to about 1400° F. (about 760° C.).

René 77 is a gamma prime (principally $Ni_3(Al,Ti)$) strengthened nickel-base superalloy. As reported in U.S. Pat. No. 4,478,638, René 77 has a composition of, by weight, 14.25-15.75% cobalt, 14.0-15.25% chromium, 4.0-4.6% aluminum, 3.0-3.7% titanium, 3.9-4.5% molybdenum, 0.05-0.09% carbon, 0.012-0.020% boron, maximum 0.5% iron, maximum 0.2% silicon, maximum 0.15% manganese, maximum 0.04% zirconium, maximum 0.015% sulfur, maximum 0.1% copper, balance nickel and incidental impurities, and an electron vacancy number ($N_v$) of 2.32 maximum. According to an aspect of the invention, René 77 is believed to be capable of exhibiting high temperature properties over an operating temperature range from room temperature to about 1400° F. (about 760° C.) that render the alloy suitable for steam turbine buckets. A preferred nominal composition is, by weight, about 15% cobalt, 15% chromium, 4.3% aluminum, 3.3% titanium, 4.2% molybdenum, 0.07% carbon, 0.015% boron, balance nickel and incidental impurities. The composition of René 77 has seen extensive use for low pressure turbine (LPT) blades in gas turbine engines used in aviation applications, but has not been used in steam turbine bucket applications.

René 77 can be cast using known methods to have a polycrystalline equiaxed (EA) microstructure preferred for steam turbine bucket applications, such as represented in FIGS. 1 and 2. After casting, the bucket is solution heat treated at a solution temperature of about 1100 to about 1200° C. (about 2010 to about 2190° F.), for example about 1160° C. (about 625° F.), in an inert atmosphere (for example, a vacuum or an inert gas) for a duration of about one to about five hours, for example about two hours, after which the casting is cooled to a temperature of about 1000 to about 1100° C. (about 1830 to about 2010° F.), for example about 1080° C. (about 1975° F.). Thereafter, the casting is further cooled to a temperature of about 500 to about 600° C. (about 930 to about 1110° F.), for example about 540° C. (about 1000° F.), and then cooled to about 20° C. (room temperature). The bucket is then aged at a temperature of about 700 to about 800° C. (about 1290 to about 1470° F.), for example about 760° C. (about 1400° F.), for about ten to about twenty hours, for example about sixteen hours, and then allowed to air cool to about 20° C. (room temperature). Further details concerning a suitable heat treatment can be found in Superalloy II 128 (Sims, Stollof and Hagel ed. 1987).

Bucket castings formulated and processed as described above are capable of exhibiting a combination of yield strength, stress rupture properties, environmental resistance, castability, microstructural stability and cost well suited for steam turbine applications to 1400° F. (about 760° C.). For example, bucket castings produced with René 77 are capable of 0.2% yield strengths of at least 100 ksi (about 690 MPa) over the temperature range from room temperature (about 20° C.) to about 1400° F. (about 760° C.), as indicated in FIG. 3. The high yield strength throughout this temperature range is an important benefit with respect to providing adequate capabilities for a steam turbine bucket to withstand steady-state and transient loads, and to maintain adequate pre-stress in the bucket airfoil to assure that adjacent bucket covers (18 in FIGS. 1 and 2) remain coupled during operation. The gamma prime phase content (volume fraction) of the bucket casting is preferably at least 45%, for example, about 45% to about 55%, at a temperature of about 760° C. (about 1400° F.). Furthermore, buckets castings formulated and processed as described above preferably have a very low sigma phase (σ) content, for example less than 5% by volume at a temperature of about 760° C. (about 1400° F.). As known in the art, the sigma phase is a brittle topologically close-packed (TCP) phase with the general formula $(Fe,Mo)_x(Ni,Co)_y$ where x and y=1 to 7, and can form in a nickel-base superalloy in the presence of sufficient levels of bcc transition metals, such as tantalum, niobium, chromium, tungsten and molybdenum. Because sigma phase forms as brittle plate-like precipitates at high temperatures, the avoidance or minimizing of this phase is desirable for steam turbine bucket applications within the temperature range of 1300 to 1400° F. (about 705 to about 760° C.) intended for the present invention. Preferred bucket chemistries are expected to have a low PhaComp number ($N_v$) of 2.32 or less, which corresponds to the average electron-vacancy concentration per atom in the alloy matrix after accounting for known phase reactions. The low $N_v$ value of 2.32 indicates a low potential for forming brittle sigma phase in the matrix. Notably, higher $N_v$ values (for example 2.45) have been associated with sigma phase formation in René 77 at temperatures of about 1600° F. (about 870° C.) when subjected to applied stresses of about 40 ksi (about 276 MPa).

Figure 4:
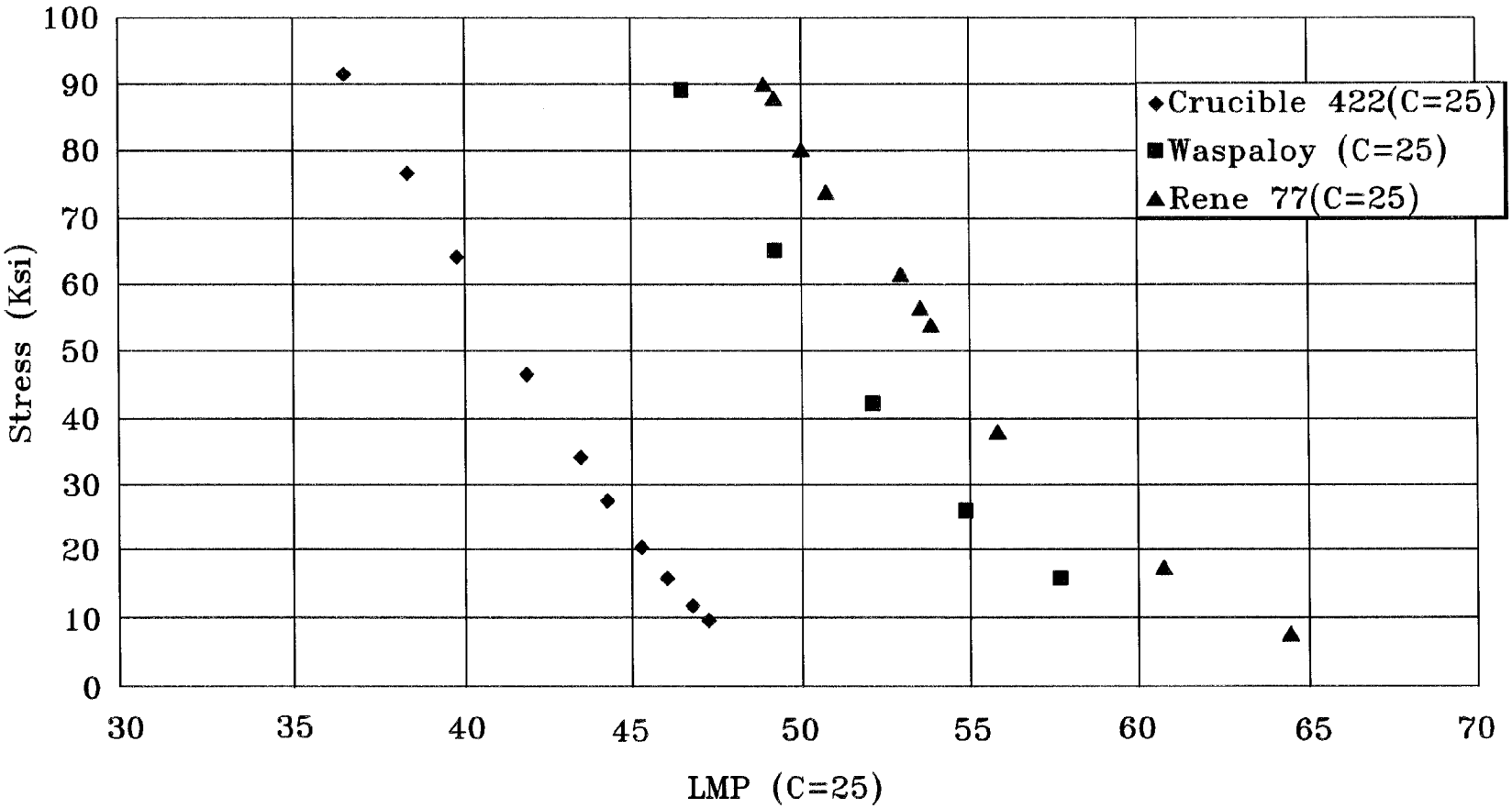
FIG. 4 is a graph plotting applied stress versus Larson-Miller parameter (LMP) for Crucible 422, Waspaloy, and René 77 over a temperature range corresponding to steam turbine bucket applications of up to 1400° F. (about 760° C.).
Figure 5:
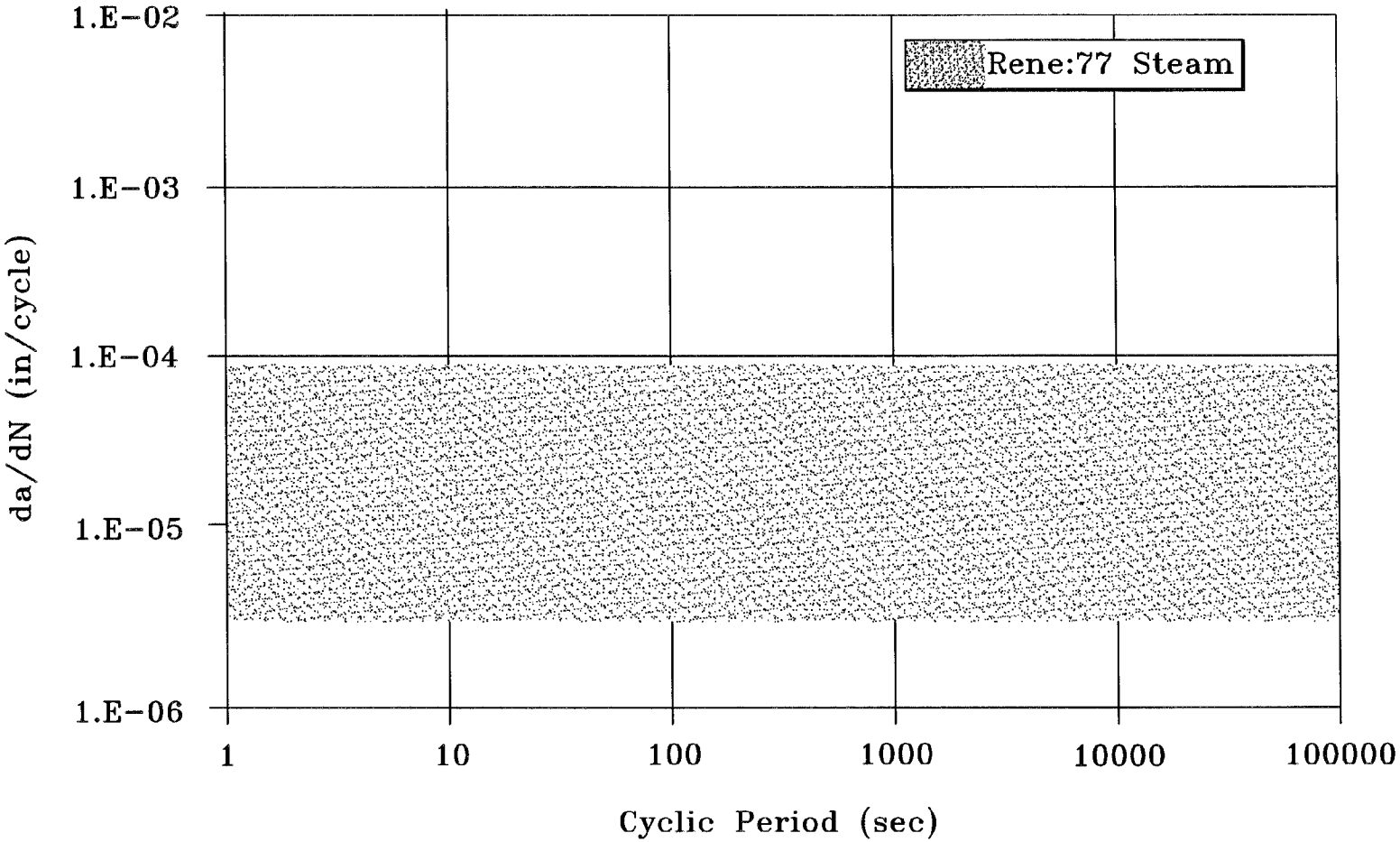
FIGS. 5 and 6 are graphs representing, respectively, a data range and specific data obtained from hold time (dwell) fatigue crack growth rate (HTFCGR; da/dN) tests performed in steam on René 77 castings in the non-heat-treated condition.
Figure 6:
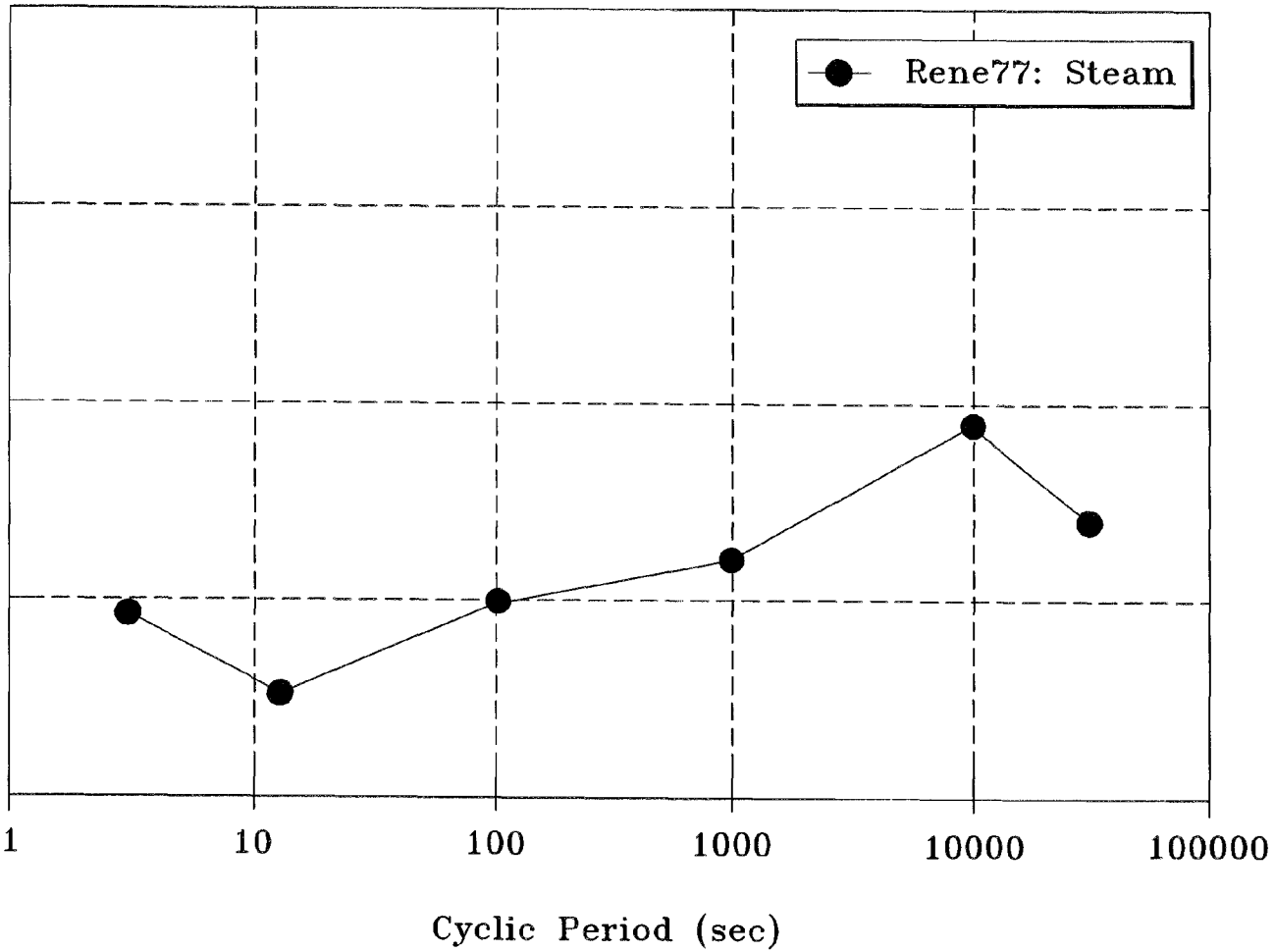

The present invention has demonstrated that René 77 has additional desirable properties at elevated temperatures, including mechanical properties such as stress rupture properties. As evident from FIG. 4, which plots applied stress versus Larson-Miller parameter (LMP), René 77 was shown to exhibit stress rupture properties that are superior to Crucible 422 and Waspaloy, and furthermore are necessary for steam turbine bucket applications at temperatures up to 1400° F. (about 760° C.). René 77 has additional desirable environmental properties at elevated temperatures, including resistance to hold time cracking, oxidation, and hot corrosion. For example, FIG. 5 represents the range of data obtained from hold time (dwell) fatigue crack growth rate (HTFCGR; da/dN) tests performed in steam on René 77 castings in the non-heat-treated condition, and FIG. 6 plots data from one of these tests. Test conditions were 1400° F. (about 760° C.), R=0.1, and a maximum stress intensity (Δk) of 25 ksi √in (about 27.5 MPa √m). The scatterband of FIG. 5 evidences a relatively flat trend observed in the data with respect to hold time, and supports a conclusion that the alloy is not highly sensitive to the steam turbine environment. FIG. 6 evidences that a slight departure from time independent crack propagation occurred at a hold time of about 100 seconds, but René 77 did not achieve full time dependence at hold times of about 32,000 seconds and less. It is believed that René 77 is capable of exhibiting even greater resistance to hold time cracking in the fully heat-treated condition. The high temperature solution heat treatment described above is believed to be particularly necessary to promote the resistance of René 77 to hold-time cracking in applications such as steam turbine buckets.

While the invention has been described in terms of specific embodiments, it is apparent that other forms could be adopted by one skilled in the art. For example, the physical configuration of the bucket casting can differ from that shown, and the invention can be applied to steam turbine nozzles (stationary blades) as well as buckets (rotating blades). Therefore, the scope of the invention is to be limited only by the following claims.

The invention claimed is:

1. A process of producing a steam turbine blade, the process comprising:

casting the blade from a gamma prime-strengthened nickel-base superalloy having a composition of, by weight, 14.25-15.75% cobalt, 14.0-15.25% chromium, 4.0-4.6% aluminum, 3.0-3.7% titanium, 3.9-4.5% molybdenum, 0.05-0.09% carbon, 0.012-0.020% boron, maximum 0.5% iron, maximum 0.2% silicon, maximum 0.15% manganese, maximum 0.04% zirconium, maximum 0.015% sulfur, maximum 0.1% copper, balance nickel and incidental impurities, and an electron vacancy number of 2.32 maximum;

solution heat treating the blade at a solution temperature of about 1100 to about 1200° C. in an inert atmosphere for a duration of about one to about four hours;

cooling the blade to a first cooling temperature of about 1000 to about 1100° C.;

cooling the blade to a second cooling temperature of about 500 to about 600° C.;

cooling the blade to about room temperature;

aging the blade at an aging temperature of about 700 to about 800° C. for about ten to about 20 hours; and then cooling the blade to about room temperature;

wherein the blade has a 0.2% average yield strength of greater than 690 MPa over a temperature range of about 20° C. to about 760° C., a gamma prime phase content of about 45% to about 55% by volume at a temperature of about 760° C., and a sigma phase content of less than 5% by volume at a temperature of about 760° C.

2. The process according to claim 1, wherein the solution temperature is about 1160° C. and the duration of the solution heat treating step is about two hours.

3. The process according to claim 1, wherein the first cooling temperature is about 1080° C.

4. The process according to claim 1, wherein the second cooling temperature is about 540° C.

5. The process according to claim 1, wherein the aging temperature is about 760° C. and the duration of the aging step is about sixteen hours.

6. The process according to claim 1, wherein the casting has an equiaxed microstructure.

7. The process according to claim 1, wherein the blade is a steam turbine bucket adapted for a steam turbine having an operating temperature of greater than 705° C.

8. The process according to claim 1, wherein the blade is a steam turbine bucket adapted for a steam turbine having an operating temperature of 705° C. to 760° C.

9. The process according to claim 1, further comprising the step of installing the blade on a steam turbine wheel of a steam turbine having an operating temperature of greater than 705° C.

10. A process comprising:

casting a steam turbine bucket from a gamma prime-strengthened nickel-base superalloy having a composition of, by weight, 14.25-15.75% cobalt, 14.0-15.25% chromium, 4.0-4.6% aluminum, 3.0-3.7% titanium, 3.9-4.5% molybdenum, 0.05-0.09% carbon, 0.012-0.020% boron, maximum 0.5% iron, maximum 0.2% silicon, maximum 0.15% manganese, maximum 0.04% zirconium, maximum 0.015% sulfur, maximum 0.1% copper, balance nickel and incidental impurities, and an electron vacancy number of 2.32 maximum;

solution heat treating the bucket at a solution temperature of about 1100 to about 1200° C. in an inert atmosphere for a duration of about one to about four hours;

cooling the bucket to a first cooling temperature of about 1000 to about 1100° C.;

cooling the bucket to a second cooling temperature of about 500 to about 600° C.;

cooling the bucket to about room temperature;

aging the bucket at an aging temperature of about 700 to about 800° C. for about ten to about 20 hours;

cooling the bucket to about room temperature; and then installing the bucket on a steam turbine wheel of a steam turbine having an operating temperature of greater than 705° C.;

wherein the bucket has a 0.2% average yield strength of greater than 690 MPa over a temperature range of about 20° C. to about 760° C., a gamma prime phase content of about 45% to about 55% by volume at a temperature of about 760° C., and a sigma phase content of less than 5% by volume at a temperature of about 760° C.

11. The process according to claim 10, wherein the solution temperature is about 1160° C. and the duration of the solution heat treating step is about two hours.

12. The process according to claim 10, wherein the first cooling temperature is about 1080° C.

13. The process according to claim 10, wherein the second cooling temperature is about 540° C.

14. The process according to claim 10, wherein the aging temperature is about 760° C. and the duration of the aging step is about sixteen hours.

15. The process according to claim 10, wherein the casting has an equiaxed microstructure.

* * * * *